US005246208A

United States Patent [19]

Mailliet et al.

[11] Patent Number: 5,246,208

[45] Date of Patent: Sep. 21, 1993

[54] METHOD FOR BOTTING THE TAP HOLE OF A SHAFT FURNACE AND BOTTING MACHINE FOR THE IMPLEMENTATION OF THIS METHOD

[75] Inventors: Pierre Mailliet, Howald; Jean Metz, Luxembourg, both of Luxembourg

[73] Assignee: Paul Wurth S.A., Luxembourg

[21] Appl. No.: 874,343

[22] Filed: Apr. 24, 1992

[30] Foreign Application Priority Data

Apr. 26, 1991 [LU] Luxembourg ..... 87-926

[51] Int. Cl.[5] ..... C21B 7/12

[52] U.S. Cl. ..... 266/45; 266/271; 266/273

[58] Field of Search ..... 266/45, 273, 271, 272

[56] References Cited

U.S. PATENT DOCUMENTS

| | | | |
|---|---|---|---|
| 2,228,255 | 1/1941 | Brosius | 266/273 |
| 4,247,088 | 1/1981 | Ueno et al. | 266/273 |
| 4,544,143 | 10/1985 | Cooper et al. | 266/271 |
| 4,557,468 | 12/1985 | Mailliet et al. | 266/273 |

*Primary Examiner*—Scott Kastler

*Attorney, Agent, or Firm*—Fishman, Dionne & Cantor

[57] ABSTRACT

A method is provided for botting a tap hole of a shaft furnace using a botting gun fitted with a first hydraulic actuating cylinder holding the botting gun in bearing contact against the wall of the furnace, while a second actuating cylinder actuates a piston which injects the botting mass into the tap hole. In order to limit the contact pressures between the tip of the botting gun and the wall of the furnace, the supply pressure $P_1$ of the first actuating cylinder is modulated as a function of the supply pressure $P_2$ of the second actuating cylinder.

7 Claims, 5 Drawing Sheets

METHOD FOR BOTTING THE TAP HOLE OF A SHAFT FURNACE AND BOTTING MACHINE FOR THE IMPLEMENTATION OF THIS METHOD

BACKGROUND OF THE INVENTION

The present invention relates to a method for botting a tap hole in a wall of a shaft furnace with the aid of a botting gun mounted on a carrier arm which can pivot about a support column through the action of at least a first hydraulic actuating cylinder, the said botting gun comprising a chamber in which a piston slides, said piston being actuated by a second hydraulic actuating cylinder in order to eject a botting mass, via a frontal muzzle of the botting gun, into the tap hole while the botting gun is held in bearing contact against the wall of the furnace through the action of the first hydraulic actuating cylinder. The invention also relates to a botting machine for the implementation of this method.

It is known that the tap holes of a shaft furnace and, more particularly, of a blast furnace, are botted with a plugging-up, or botting mass. This botting mass is inserted into the tap hole under a very high pressure with the aid of a botting gun or clay gun, and it plugs up the tap hole upon hardening. the botting masses are generally based on clay with synthetic additives accelerating the hardening process. Because of the high pressure under which modern blast furnaces work and the properties of the botting masses currently used, very high botting pressures are required in order to plug up the tap holes.

Modern botting guns are designed to operate at a botting pressure which can reach $200\times10^5$ Pa or more at the exit of the frontal muzzle. In order to be able to operate at such a botting pressure, a hydraulic working pressure of the order of $300\times10^5$ Pa is used in current botting guns.

During the botting process, the tip of the botting gun's frontal muzzle is pressed against the wall of the furnace. In order to insure sealing and to prevent leakage between the wall of the furnace and the muzzle of the botting gun, it is necessary to maintain between 10% and 20% of the botting pressure as a minimum contact pressure between the wall of the furnace and the tip of the frontal muzzle. Of course is it also necessary to balance the reaction exerted by the botting mass on the botting gun as this reaction tends to move the botting gun away from the tap hole. This reaction is proportional to the botting pressure. Up until now, this has been carried out by subjecting the hydraulic actuating cylinder which actuates the carrier arm of the botting gun to the full working pressure of the hydraulic system throughout the entire botting process.

Although botting guns are designed to perform the botting under these high pressures, it should be pointed out that this maximum pressure is not exerted throughout the entire botting process. In fact, in the initial phase, when the tap hole offers little resistance to the botting mass, the pressure exerted in order to eject the mass through the muzzle into the tap hole is relatively low, on the order of $50\times10^5$ Pa or less. This pressure increases progressively until at the end of the botting process it reaches values on the order of $200\times10^5$ Pa. This means that if throughout the botting process, the botting gun is applied with a constant force such as is required to maintain its contact against the wall of the furnace at the end of the botting process, this force is, at the start of the botting operation, at least four times greater than the actual force required. In fact, given that the reaction exerted by the botting mass on the botting gun increases only in proportion to the botting pressure, the contact pressure between the wall of the furnace and the tip of the frontal muzzle is four times higher at the start of the botting process than at the end, when it is equivalent to the minimum pressure required in order to insure the sealing between the wall of the furnace and the tip of the frontal muzzle. This high contact pressure at the start of the process runs the risk of breaking or pushing in the bricks surrounding the tap hole, this being all the more so since the annular rim of the muzzle of the botting gun has a relative sharp edge.

SUMMARY OF THE INVENTION

The object of the present invention is to provide a novel botting method and a novel botting machine which enable the risks of damaging the wall of the furnace around the tap hole during the botting operation to be reduced.

In order to achieve this objective, the present invention provides a method for botting a tap hole in a wall of a shaft furnace using a botting gun mounted on a carrier arm which can pivot about a support column through the action of at least a first hydraulic actuating cylinder, the said botting gun comprising a chamber in which a piston slides, through the action of a second actuating cylinder operating at a variable pressure, in order to eject a botting mass via a frontal muzzle of the botting gun into the tap hole while the botting gun is held in bearing contact against the wall of the furnace through the action of the first hydraulic actuating cylinder, characterized in that the supply pressure $P_1$ of the first hydraulic actuating cylinder, in order to hold the botting gun in bearing contact against the wall of the furnace, is modulated during the botting operation as a function of the variable supply pressure $P_2$ of the second actuating cylinder which actuates the piston ejecting the botting mass.

The modulation is preferably performed according to the relationship $P_1(t)=k\cdot P_2(t)$, in which k is a predetermined constant depending, for a given machine, on the properties of the botting mass, $P_1(t)$ is the supply pressure at the moment of time t of the first actuating cylinder holding the botting gun in bearing contact against the wall of the furnace and $P_2(t)$ is the supply pressure at the moment of time t of the second actuating cylinder which actuates the ejector piston.

The modulation is preferably carried out in such a manner that the bearing pressure $P_1(t)$ does not fall below a predetermined minimum pressure $P_{min}$.

This modulation of the bearing pressure of the botting gun enables the force with which the botting gun is applied against the wall of the furnace to be increased progressively and in proportion to the botting pressure. This measure allows avoidance of excessively high contact pressures between the tip of the botting gun and the wall of the furnace, which therefore minimizes the risk of damaging the perimeter of the tap hole.

The invention also provides a device for botting a tap hole, provided in the wall of a shaft furnace, the said device comprising a botting gun mounted on a carrier arm which can pivot about a support column through the action of at least a first hydraulic actuating cylinder operating under a pressure $P_1$, the said botting gun comprising a chamber in which a piston slides, said piston being actuated by a second hydraulic actuating cylinder operating under a variable pressure $P_2$ in order to eject the botting mass via a frontal muzzle of the botting gun into the tap hole, while the botting gun is held in bearing contact against the wall of the furnace through the action of the said first hydraulic actuating cylinder, and a supply system for delivering a hydraulic fluid at a working pressure $P_o$ and to control hydraulically the first actuating cylinder and the second actuating cylinder via a hydraulic circuit, characterized by a first supply circuit of the first hydraulic actuating cylinder connected to the working pressure $P_o$ of the supply system via a pressure-reducing valve defining a minimum pressure $P_{min}$ and by a second supply circuit of the first actuating cylinder in which the hydraulic pressure is a function of the variable supply pressure $P_2$ of the second actuating cylinder actuating the piston of the botting gun.

According to a first embodiment, the second circuit is connected to the supply pressure $P_2$ of the actuating cylinder actuating the piston of the botting gun via non-return valves which are control operated in order to open.

According to a second embodiment, the second circuit comprises a regulatable pressure-regulating valve connected to the working pressure $P_o$ and control operated by a pressure sensor measuring the supply pressure $P_2$ of the hydraulic actuating cylinder which actuates the Piston of the botting gun. This circuit may furthermore comprise a device for scaling up or scaling down the measurements of the pressure sensor in order to provide a modulation according to the relationship $P_1 = k \cdot P_2$.

The above discussed and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
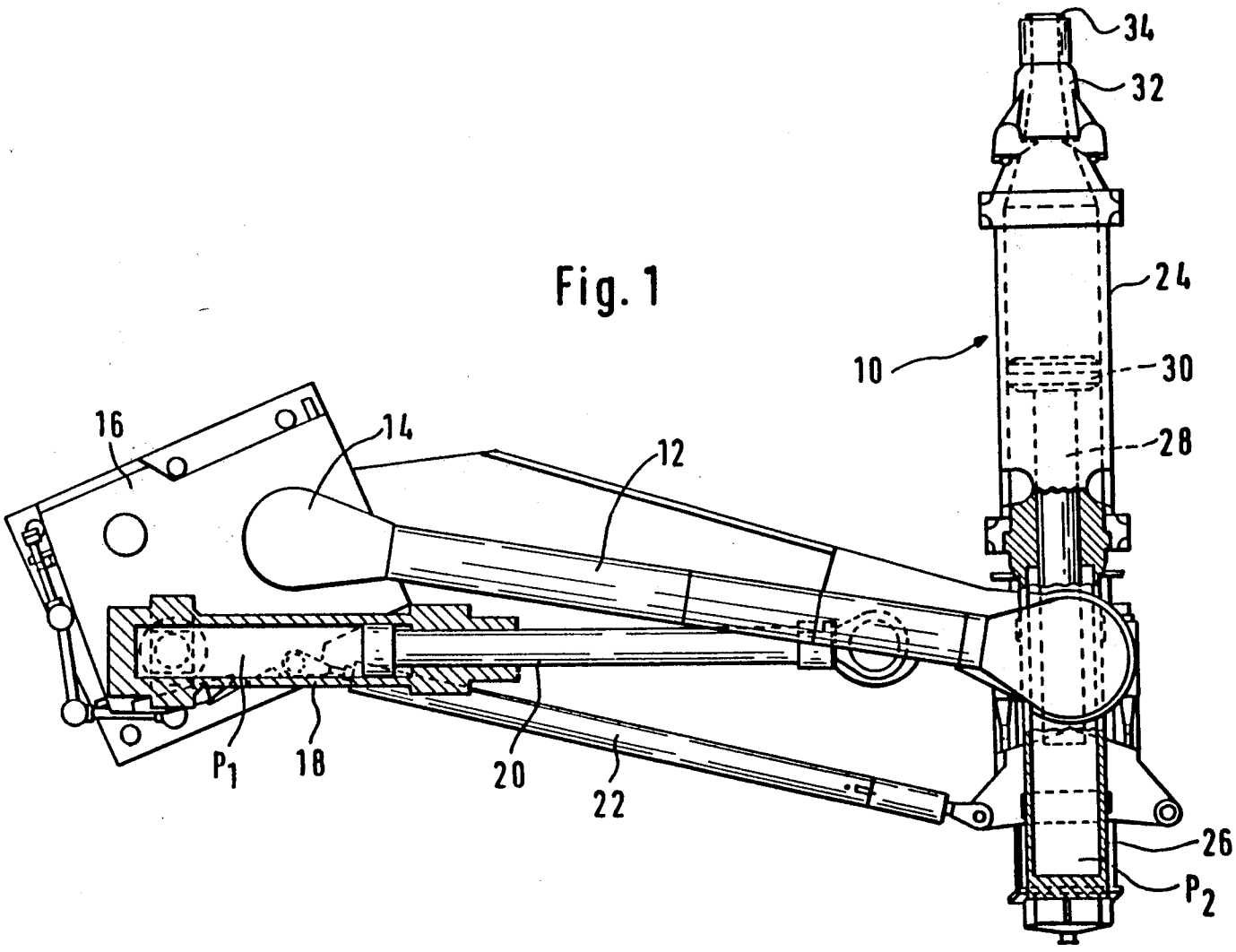
FIG. 1 shows diagrammatically a plan view, in partial cross-section, of a machine for botting a tap hole of a shaft furnace.

FIG. 1 represents diagrammatically a machine for botting a tap hole of a blast furnace. This machine comprises a botting gun 10 supported by one of the two ends of a carrier arm 12 whose opposite end pivots about a column 14 erected on a base 16. The pivoting of the carrier arm 12 is carried out through the action of a hydraulic actuating cylinder 18 mounted on the base 16 and whose rod 20 acts directly on the carrier arm 12. The reference 22 represents a rod for guiding and steering the botting gun 10 during the movement of the carrier arm 12. The botting gun 10 comprises a cylindrical clay chamber 24 which is extended rearwards by a second hydraulic actuating cylinder 26 whose rod 28 acts on a piston 30 which slides in the cylindrical chamber 24. The botting mass contained in the chamber 24 is ejected from the latter through the effect of the thrust of the piston 30 via a narrowed muzzle 32 comprising, at its end or its tip, a shoulder 34 surrounding the exit opening. This shoulder 34 has to be applied sealingly against the wall of the furnace around the tap hole during the injection of the botting mass into the tap hole.

The reference $P_2$ represents the hydraulic supply pressure of the second hydraulic actuating cylinder 26 in order to move the ejector piston 30 in the chamber 24. This hydraulic pressure has not only to provide the work of injecting the botting mass into the tap hole but also the work of deforming the mass in order to eject it via the narrowed muzzle 32. In the machine shown, it may be observed that when the botting pressure rises up to $200 \times 10^5$ Pa it is necessary to use a hydraulic working pressure $P_2$ on the order of $300 \times 10^5$ Pa in order to inject the mass.

The reference $P_1$ represents the hydraulic supply pressure of the actuating cylinder 18. This pressure has different orders of magnitude depending on whether this is for moving the botting gun or for holding it in sealed bearing contact against the wall of the furnace during the botting process.

A hydraulic system, not shown, provides the hydraulic fluid at the working pressure $P_o$, the maximum value of which is of the order of $300 \times 10^5$ Pa, in order to supply both the actuating cylinder 18 and the hydraulic cylinder 26 of the botting gun 10 via a hydraulic circuit.

While up until now the supply pressure $P_1$ of the actuating cylinder 18 corresponded to the maximum working pressure $P_o$ throughout the duration of the botting, the present invention proposes to modulate the pressure $P_1$ of the actuating cylinder 18 as a function of the supply pressure $P_2$ required for moving the piston 30 and injecting the botting mass into the tap hole.

Figure 2:
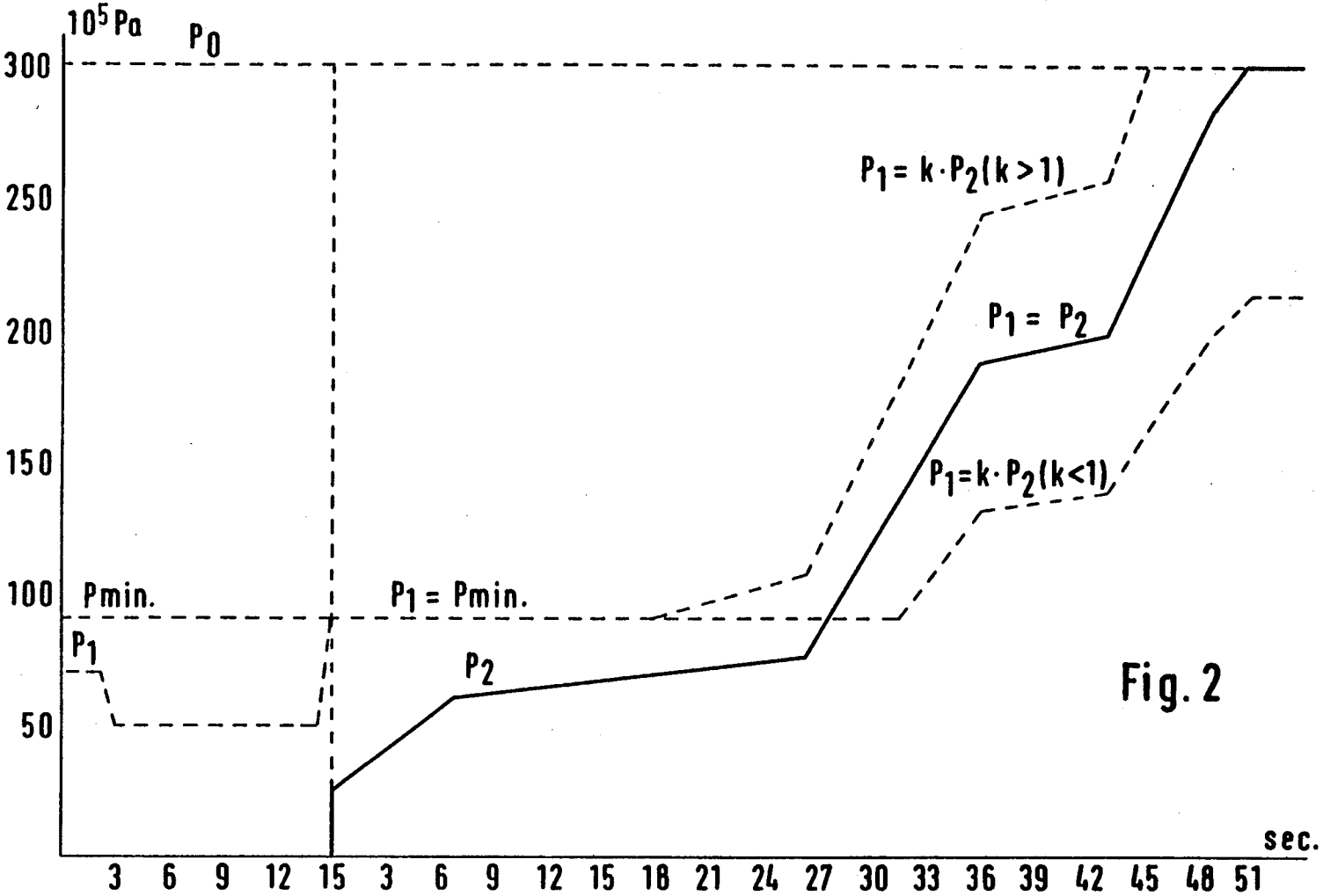
FIG. 2 represents a graph showing the change with time of the hydraulic pressures during a botting process.

The diagram of FIG. 2 shows the change with time of the pressures in the course of a botting operation which, in the example represented, is assumed to last about fifty seconds. The maximum pressure available by the hydraulic system is the pressure $P_o$ of the order of $300 \times 10^5$ Pa.

The first 15 seconds are provided for moving the botting gun from a stand-by position to the working position in bearing contact against the wall of the furnace through the action of the hydraulic actuating cylinder 18 operating at a pressure $P_1$. This pressure $P_1$ is of the order of $70 \times 10^5$ Pa for the starting up of the botting gun. Once the botting gun is moving, the pressure $P_1$ falls to a value of approximately $50 \times 10^5$ Pa in order to rise rapidly to approximately $90 \times 10^5$ Pa on contact of the muzzle 32 with the wall of the furnace.

As soon as the botting gun is in its working position after 15 seconds, the botting process is started. The curve $P_2$ represents the pressure in the hydraulic actuating cylinder 26 necessary for moving the piston 30 and for injecting the botting mass into the tap hole. During the first 25 seconds of the botting operation it is observed that the pressure $P_2$ is not very high and only rises slowly whereas during the second half of the botting operation this pressure $P_2$ rises rapidly towards the available maximum pressure $P_o$. This is due to the fact that the tap hole offers relatively little resistance to the botting mass at the start of the operation, whereas this resistance increases as the tap hole is plugged up. The change with time of the curve $P_2$ depends of course, inter alia, on the viscosity of the botting mass and on its behavior inside the tap hole.

Prior to the present invention, as soon as the botting operation commenced the pressure $P_1$ of the actuating cylinder 18 has been equal to the working pressure $P_o$. According to the present invention, the pressure $P_1$ will be held at a minimum value $P_{min}$, on the order of $90\times10^5$ Pa, in the first phase of the botting operation. In this phase, this pressure is fully sufficient to compensate for the reactions of the botting mass inserted into the tap hole on the botting gun and to insure sufficient sealing around the shoulder 34. After approximately 27 seconds of botting, that being the point at which pressure $P_2$ reaches the pressure $P_{min}$ at which the actuating cylinder 18 is held, the hydraulic pressure $P_1$ of the actuating cylinder is progressively increased in accordance with the change with time of the pressure $P_2$ until it reaches the maximum working pressure $P_o$. The curves illustrating the pressures $P_1$ and $P_2$ are consequently coincident on the graph during the second half of the botting operation (see the curve identified by the reference 100 in FIG. 2).

In practice it is preferable to have the possibility of modulating $P_1$ according to the relationship $P_1(t)=k\cdot P_2(t)$, k being a constant chosen for a given botting device, especially as a function of the properties of the botting mass. In the case discussed hereinabove, where $P_1(t)$ is equal to $P_2(t)$ during the second botting phase, k is obviously equal to 1. The two curves represented as broken lines in FIG. 2 represent examples of modulation of the bearing pressure when k is greater or less than unity (see curves identified by the reference 101 and 102). When the botting mass is relatively fluid the contact pressure between the tip of the botting gun and the wall of the shaft furnace has to be higher in order to avoid leaks and it is consequently necessary to increase the value of the constant k. The pressure $P_1$ will change with time substantially according to the upper curve. By contrast, when the botting mass has a high degree of viscosity it is possible to reduce the value of k in order for the pressure $P_1$ to follow a curve similar to the lower curve. It is obvious however that the band of variation of k essentially depends on the constructional data of the device and especially on the size of the two actuating cylinders 18 and 26 and on the geometry of the piston 30 and the tip 32.

The above-mentioned description is based on the hydraulic pressure $P_1$ of the actuating cylinder 18 and the hydraulic pressure $P_2$ of the hydraulic actuating cylinder 26 of the botting gun 10. However, the effect of the present invention will be better illustrated when the result of these curves is transposed in terms of force at the muzzle 32 of the botting gun 10. In fact, the bearing force of the botting gun against the wall of the furnace has to be able to compensate for the reactions resulting from the botting pressure and, in addition, has to insure sufficient contact pressure to prevent lateral leaks of the botting mass.

Figure 3:
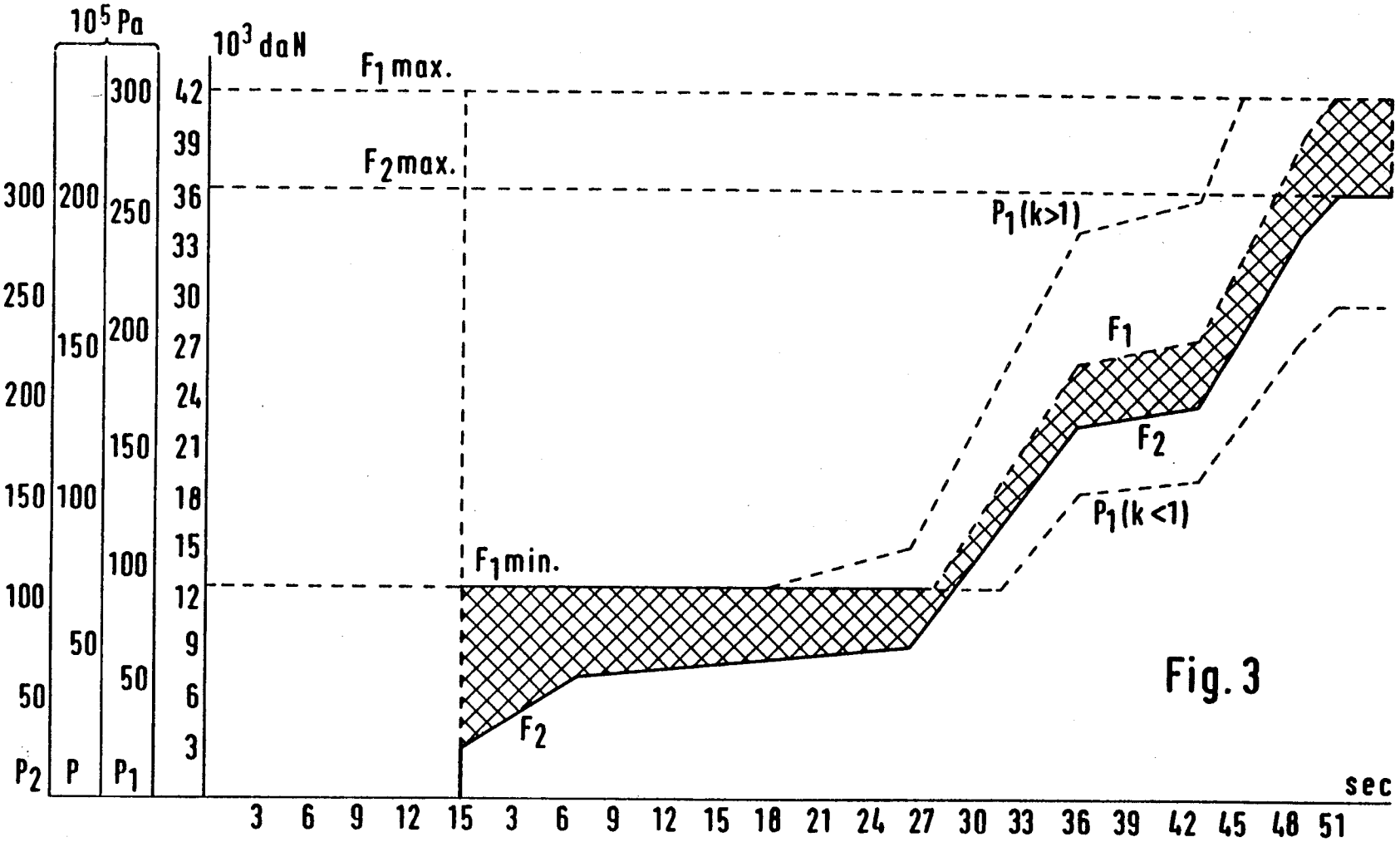
FIG. 3 represents graphically the opposing forces.

FIG. 3 illustrates, in units of 1,000 daN, the forces generated by the pressures $P_1$ and $P_2$ as a function of the botting time. Along the ordinate, facing the units of force and in units of $10^5$ Pa, are the corresponding pressures $P_1$ and $P_2$ of the hydraulic cylinder 18 and the actuating cylinder 26 respectively. Between these two ordinates $P_1$, $P_2$ is the botting pressure P, that is to say the pressure exerted on the botting mass at the exit opening via the muzzle 32. When the pressure $P_o=300\times10^5$ Pa, a botting pressure P of the order of $200\times10^5$ Pa is measured.

Corresponding to the maximum pressure $P_1$ of $300\times10^5$ Pa is a force $F_1$ max. of $42\times10^3$ daN exerted by the first actuating cylinder on the botting gun 10 in the direction of the wall of the furnace. By contrast, corresponding to the maximum botting force $P=200\times10^5$ Pa is a maximum reaction of the order of $36\times10^3$ daN exerted by the botting mass on the device. This reaction tends to move the botting machine away from the tap hole and, consequently, is subtracted from $F_1$ max. In other words, the maximum force exerted by the first actuating cylinder on the botting gun exceeds the said maximum reaction by the order of 17%, which is sufficient to produce a contact pressure between the shoulder 34 and the wall of the furnace, which prevents lateral leaks of the botting mass.

Curve $F_2$ represents the reaction on the botting machine resulting from the botting pressure during the botting process. The overall appearance of this curve necessarily corresponds to that of $P_2$ of FIG. 2. Curve $F_1$ represents the bearing force of the botting gun against the wall of the furnace through the action of the pressure $P_1$. This curve consequently comprises a horizontal level region corresponding to the minimum pressure of FIG. 2 and has an overall appearance which corresponds to curve $P_1$ of FIG. 2.

The cross-hatched area between the two curves $F_1$ and $F_2$ represents the change with time in the difference $(F_1-F_2)$ of the two forces. This difference represents the bearing force actually exerted on the wall of the furnace by the agency of the shoulder 34. This difference $(F_1-F_2)$ is a faithful image of the actual contact pressure between the shoulder 34 and the wall of the furnace. It is observed that this contact pressure has a maximum at the start of the botting process but that this maximum represents only 20% of the contact pressure corresponding to $(F_1\text{ max.}-F_2)$ at the same moment of time. The contact pressure then decreases during the first half of the botting process to reach its minimum after approximately 27 seconds and increases subsequently up to a relative maximum when $F_1=F_1$ max.

Figure 4:
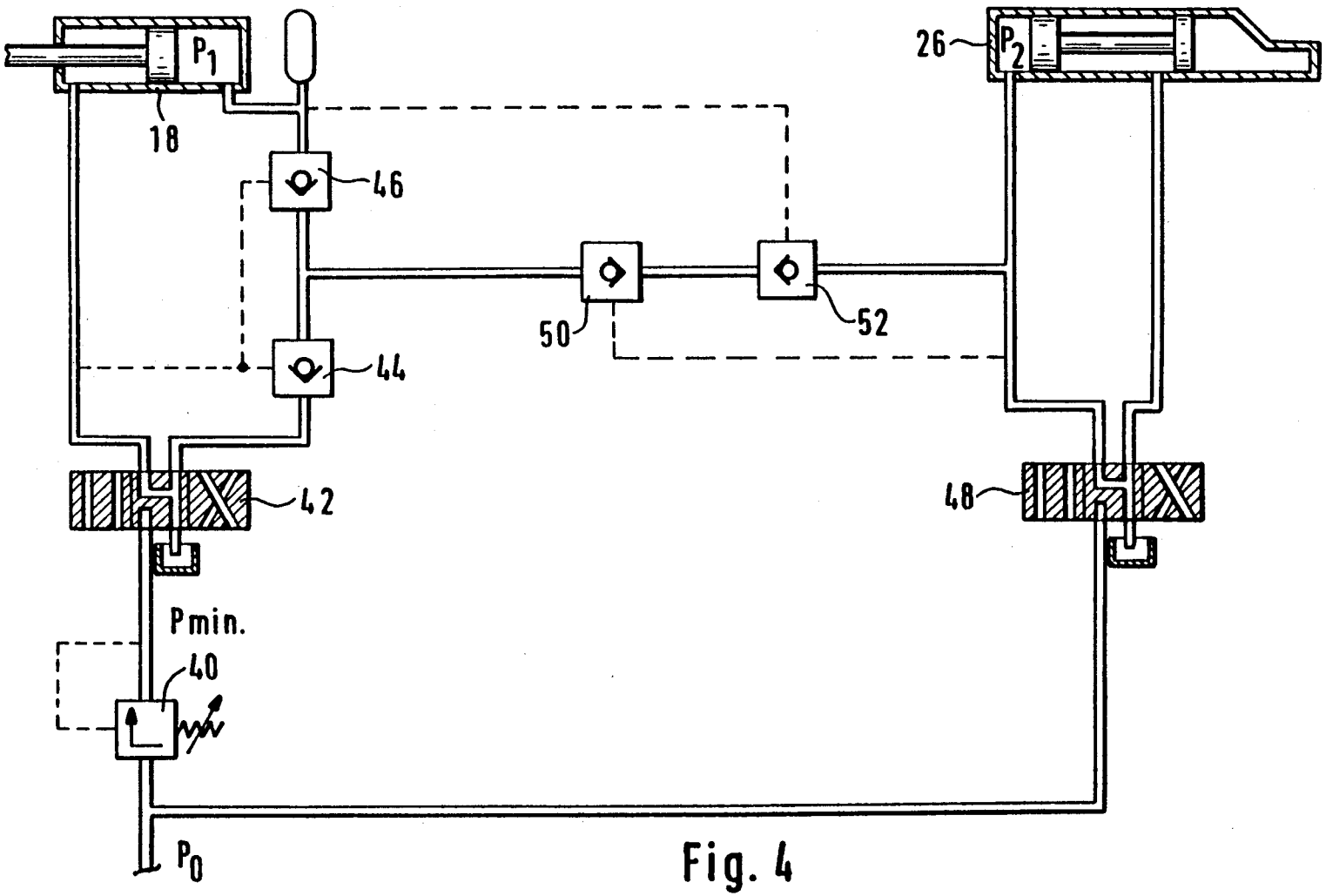
FIG. 4 represents a hydraulic diagram of a first embodiment of a circuit for modulating the bearing pressure of the botting gun.

FIG. 4 illustrates a first embodiment of a hydraulic circuit for modulating the pressure $P_1$ of the actuating cylinder 18 as a function of the hydraulic pressure $P_2$ of the hydraulic cylinder 26. The working pressure $P_o$, of a value on the order of $300\times10^5$ Pa, is provided by a hydraulic system which is not shown. This working pressure $P_o$ is reduced to the value $P_{min}$ in a pressure-reducing valve 40. The actuating cylinder 18 is supplied with hydraulic fluid at this pressure $P_{min}$ via a distributor valve 42 and two non-return valves 44 and 46 in order to move the botting gun from the stand-by position to the operating position and in order to bring the botting gun to bear against the wall of the furnace at the pressure $P_{min}$ at the start of the botting process according to FIG. 2.

The hydraulic actuating cylinder 26 is supplied via a distributor valve 48 and the supply pressure $P_2$ actuating the hydraulic actuating cylinder 26 increases progressively during the botting process in accordance with curve $P_2$ of FIG. 2.

With a view to modulating the pressure $P_1$ as a function of the pressure $P_2$, the feed circuit of the actuating cylinder 18 is connected to the feed circuit of the cylinder 26 via two non-return valves 50 and 52 which are control operated for opening. These two valves 50 and 52 prevent the hydraulic fluid from passing uncontrolled from one circuit to the other. When the actuating cylinder 18 is supplied at the minimum pressure $P_{min}$ the valve 52 is automatically opened through the effect of this pressure. By contrast, the non-return valve 50 prevents the hydraulic fluid from flowing at the pressure $P_{min}$ toward the supply circuit of the hydraulic actuating cylinder 26. The non-return valve 50 is control operated by the pressure of the supply circuit of the cylinder 26 in such a manner as to open only when the pressure $P_2$ exceeds the pressure $P_{min}$. Consequently, from that moment on, the hydraulic fluid can flow from the supply circuit of the cylinder 26 via the open valve 52 under the control of the pressure $P_1$ and via the valve 50 into the supply circuit of the actuating cylinder 18 in order for the pressure $P_1$ to equal the pressure $P_2$. Consequently, from opening the valve 50 onwards, the situation returns to the one illustrated by FIG. 2 when $P_1$ equals $P_2$, the constant k not being involved in the circuit according to FIG. 4.

It should be noted that the non-return valve 5 which is control operated for opening is not necessary for the modulation of the pressure $P_1$ in accordance with the present invention. This valve serves to prevent the hydraulic fluid from passing into the circuit of the actuating cylinder 18 when, for example, the actuating cylinder 26 is actuated in the stand-b position of the botting gun which a view to filling it.

Figure 5:
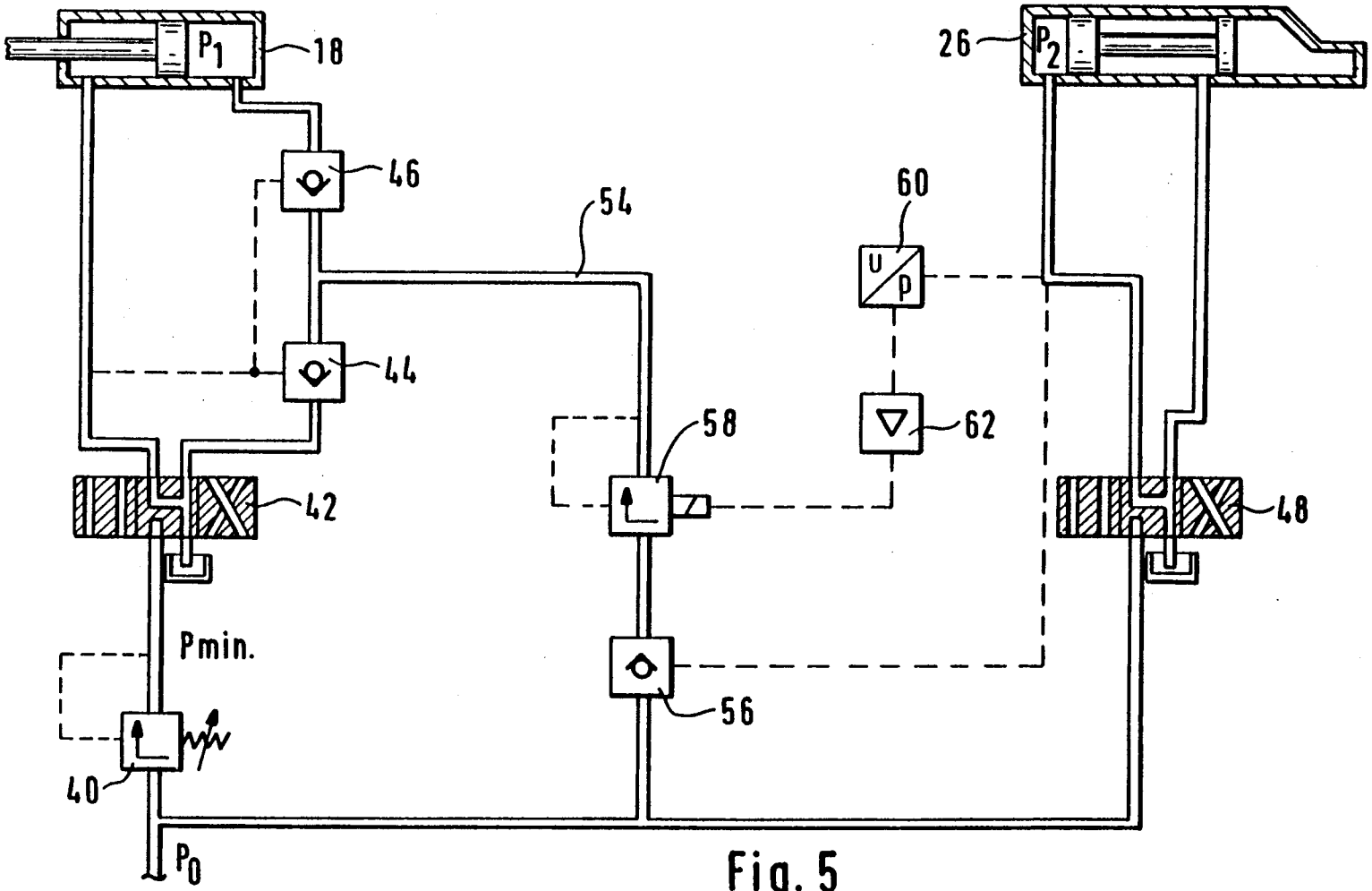
FIG. 5 represents a hydraulic diagram of a second embodiment of a circuit for modulating the bearing pressure of the botting gun.

FIG. 5 illustrates an embodiment of a circuit involving the constant k for modulating $P_1$ according to a relationship of the type $P_1=k\cdot P_2$, where k differs from unity. In FIG. 5, identical references to those in FIG. 4 have been used for designating corresponding elements.

The supply of the actuating cylinder 18 at the minimum pressure $P_{min}$ according to the diagram of FIG. 5 is identical to that of the mode of operation according to FIG. 4. However, contrary to FIG. 4, the second supply circuit of the actuating cylinder 18 is not connected directly to the supply circuit of the cylinder 26 but it is connected by a parallel circuit 54 to the working pressure $P_o$ of the hydraulic system. This second circuit 54 is involved as soon as the pressure $P_2$ exceeds the minimum pressure $P_{min}$. It is opened by a non-return valve 56 which is control operated for opening, the opening of which is automatically controlled by the supply circuit of the cylinder 26 when the pressure $P_2$ reaches the value $P_{min}$. The circuit 54 furthermore comprises a pressure-regulating valve 58 placed under the control of a pressure sensor 60. The latter measures the pressure $P_2$ and control operates the pressure-regulating valve 58 as a function of the value of $P_2$ via a scaling-up or scaling-down device 62. This device 62 enables the constant k to be introduced and the modulation of the pressure $P_1$ to be performed according to the formula $P_1(t)=k\cdot P_2(t)$. In other words, the pressure-reducing valve 58 is automatically controlled in order to reduce the pressure $P_o$ to the pressure $k\cdot P_2(t)$, under the control of the sensor 60 and of the device 62, from the moment that the pressure $P_2$ exceed the pressure $P_{min}$. The device 62 is designed in such a manner as to be able to adjust manually the value of the constant k, for example as a function of the properties of the botting mass.

Whereas up until now it was necessary to limit the botting pressure to approximately $200\times10^5$ Pa in order not to damage the wall of the furnace with an excessive bearing pressure, the modulation of the bearing pressure provided by the present invention enables the limit of $200\times10^5$ Pa of the botting pressure to be exceeded.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method for botting a tap hole, provided in a wall of a shaft furnace, using a botting gun mounted on a carrier arm which can pivot about a support column through the action of at least a first hydraulic actuating cylinder, said botting gun comprising a chamber in which a piston slides through the action of a second actuating cylinder in order to eject a botting mass via a frontal muzzle of the botting gun into the tap hole while the botting gun is held in bearing contact against the wall of the furnace through the action of the first hydraulic actuating cylinder, the method comprising the steps of:

supplying a first pressure to the first hydraulic actuating cylinder, in order to hold the botting gun in bearing contact against the wall of the furnace;

supplying a variable second pressure to the second actuating cylinder in order to eject the botting mass into the tap hole; and modulating said first pressure during the botting operation in response to said variable second pressure.

2. The method of claim 1, wherein said step of modulating comprises modulating according to a relationship $P_1=k\cdot P_2$, where k is a constant dependant on properties of the botting mass, $P_1$ is said first pressure, and $P_2$ is said second pressure.

3. The method of claim 1 wherein the step of modulating is carried out in such a manner that said first pressure required to maintain bearing contact of the botting gun against the wall of the furnace is sufficient to compensate for reactions of the botting mass inserted into the tap hole on the botting gun.

4. A device for botting a tap hole, provided in the wall of a shaft furnace, comprising:

a support column;

a carrier arm pivotably attached to said support column;

a first hydraulic actuating cylinder operating under a first pressure, said first hydraulic actuating cylinder being in communication with said carrier arm for pivotably actuating said carrier arm; and botting means mounted to said carrier arm, said botting means being held in bearing contact against the wall of the furnace in response to the action of said first hydraulic activating cylinder, said botting means comprising;

a chamber, a hydraulic piston slidably disposed in said chamber, a second hydraulic actuating cylinder operating under a variable second pressure for slidably moving said hydraulic piston, muzzle means for injecting a botting mass into the tap hole in response to the movement of said hydraulic piston, hydraulic delivery means for delivering a hydraulic fluid at a working pressure, and hydraulic circuit means for hydraulically controlling said first hydraulic actuating cylinder and said hydraulic piston, said hydraulic circuit means comprising, a first supply circuit connected to said first hydraulic actuating cylinder, a pressure-reducing valve connected to said hydraulic delivery means and to said first supply circuit, said pressure-reducing valve for defining a minimum pressure, and a second supply circuit connected to said first hydraulic actuating cylinder for modulating said first pressure as a function of said second pressure.

5. The device of claim 4 further comprising:

nonreturn valves being control operated in order to open, said nonreturn valves being in communication with said second pressure of said second actuating cylinder and said second supply circuit.

6. The device of claim 4 further comprising:

a pressure regulating valve being connected to said hydraulic delivery means and said second supply circuit; and a pressure sensor for measuring said second pressure of said second actuating cylinder to control operation of said pressure regulating valve.

7. The device of claim 6 further comprising:

means for scaling up or scaling down the measurements of said pressure sensor.

* * * * *